US010132597B2

(12) United States Patent
Pyles et al.

(10) Patent No.: US 10,132,597 B2
(45) Date of Patent: Nov. 20, 2018

(54) BALLISTIC-RESISTANT STRUCTURAL INSULATED PANELS

(71) Applicant: Bayer MaterialScience LLC, Pittsburgh, PA (US)

(72) Inventors: Robert A. Pyles, Bethel Park, PA (US); Kerry Ingold, Pittsburgh, PA (US)

(73) Assignee: PLASKOLITE MASSACHUSETTS, LLC, Columbus, OH (US)

( * ) Notice: Subject to any disclaimer, the term of this patent is extended or adjusted under 35 U.S.C. 154(b) by 0 days.

(21) Appl. No.: 14/573,292

(22) Filed: Dec. 17, 2014

(65) Prior Publication Data

US 2015/0168106 A1 Jun. 18, 2015

Related U.S. Application Data

(60) Provisional application No. 61/917,535, filed on Dec. 18, 2013.

(51) Int. Cl.
*F41H 5/04* (2006.01)

(52) U.S. Cl.
CPC ..... *F41H 5/0457* (2013.01)

(58) Field of Classification Search
None
See application file for complete search history.

(56) References Cited

U.S. PATENT DOCUMENTS 3,486,177 A * 12/1969 Marshack ..... A61G 7/057 219/212
3,748,137 A * 7/1973 Worth ..... G03C 1/49 430/151
3,831,922 A * 8/1974 Appleton ..... F16F 3/12 267/140
3,993,488 A * 11/1976 Oishi ..... G03C 8/34 396/518
4,061,815 A * 12/1977 Poole, Jr. ..... B32B 27/12 428/215
4,198,454 A * 4/1980 Norton ..... 428/117
4,241,129 A * 12/1980 Marton ..... B32B 15/08 428/216
4,455,801 A * 6/1984 Merritt ..... 52/309.9
4,566,237 A * 1/1986 Turner ..... 52/269
4,671,992 A * 6/1987 Lancaster ..... B29C 65/1425 428/316.6
4,683,688 A * 8/1987 Wojcinski ..... 52/79.1
4,728,566 A * 3/1988 Lancaster ..... B32B 27/16 156/272.2

(Continued)

FOREIGN PATENT DOCUMENTS

CH 671989 A5 10/1989
CN 1052733 A 7/1991

(Continued)

*Primary Examiner* — Samir Abdosh

(57) ABSTRACT

The present invention provides structural insulated panels which may afford protection from blast and ballistics events. The inventive structural insulated panel comprises a metal sheet, a polyurethane or polyisocyanurate foam and a polycarbonate sheet, film or laminate. Due to the materials of their construction, the inventive panels are light weight and a plurality of such panels may be quickly and easily assembled into sturdy, insulated, temporary or permanent shelters for protection in a variety of situations and environments.

11 Claims, 7 Drawing Sheets

(56) References Cited

U.S. PATENT DOCUMENTS 4,822,657 A * 4/1989 Simpson ..... B32B 7/02 109/80
4,856,791 A * 8/1989 McQuade ..... 273/410
5,262,447 A * 11/1993 Tucker ..... C08G 18/225 427/373
5,326,606 A * 7/1994 Labock ..... 428/49
5,390,466 A * 2/1995 Johnson et al. ..... 52/783.14
5,435,226 A * 7/1995 McQuilkin ..... 89/36.02
5,640,824 A 6/1997 Johnson et al.
5,688,837 A 11/1997 Chao et al.
5,791,118 A 8/1998 Jordan
6,080,495 A 6/2000 Wright
6,314,704 B1 11/2001 Bryant
6,656,858 B1 12/2003 Cahill
6,679,008 B2 1/2004 Santa Cruz et al.
6,713,523 B2 * 3/2004 Nagata ..... B41M 5/30 430/281.1
6,918,821 B2 * 7/2005 Balijepalli ..... B24B 53/017 451/41
7,127,865 B2 10/2006 Douglas
7,134,250 B2 11/2006 Forrester et al.
7,318,614 B2 * 1/2008 Steiger ..... B62D 33/042 296/24.4
7,357,394 B2 * 4/2008 Halverson ..... 273/410
7,398,624 B2 7/2008 Swiszcz et al.
7,406,806 B2 * 8/2008 Hallissy et al. ..... 52/481.1
7,562,508 B2 7/2009 Dickinson et al.
7,913,611 B2 * 3/2011 Terry et al. ..... 89/36.02
7,914,069 B2 3/2011 Barbe et al.
7,967,296 B1 * 6/2011 Halverson ..... 273/410
8,176,830 B1 * 5/2012 Tan ..... 89/36.02
8,408,114 B1 * 4/2013 Tan ..... 89/36.02
8,544,240 B2 * 10/2013 Hughes, Jr. ..... 52/783.17
8,590,264 B2 11/2013 Leahy
2004/0020349 A1 * 2/2004 Walker ..... 86/50
2004/0055223 A1 * 3/2004 Ono ..... B24B 37/22 51/293
2004/0060245 A1 4/2004 Loblick et al.
2004/0166779 A1 * 8/2004 Balijepalli ..... B24B 37/042 451/41
2005/0059754 A1 * 3/2005 Lunt ..... C08K 9/02 523/210
2006/0248827 A1 * 11/2006 Meeker ..... 52/309.15
2008/0078038 A1 4/2008 Borazghi
2008/0248299 A1 * 10/2008 Kuwahara ..... C09J 133/04 428/355 R
2009/0008021 A1 * 1/2009 Detert ..... B32B 37/12 156/73.1
2009/0317623 A1 * 12/2009 Purdy ..... C09C 1/043 428/327
2010/0101404 A1 * 4/2010 Lorenzo ..... F41H 5/0407 89/36.04
2011/0107905 A1 5/2011 Bourque
2011/0262703 A1 * 10/2011 Legler ..... B29C 70/086 428/156
2011/0277750 A1 * 11/2011 Peguero ..... F24J 2/0477 126/675
2014/0329060 A1 * 11/2014 Vivier ..... E04C 2/043 428/198

FOREIGN PATENT DOCUMENTS

CN 201155653 Y 11/2008
JP 2009270648 A 11/2009
WO 2005098343 A1 10/2005
WO 2011053399 A2 5/2011

* cited by examiner

BALLISTIC-RESISTANT STRUCTURAL INSULATED PANELS

RELATED APPLICATION

This application claims the benefit, under 35 USC § 119(e), of U.S. Provisional Application No. 61/917,535, filed Dec. 18, 2013 entitled "BALLISTIC-RESISTANT STRUCTURAL INSULATED PANELS"; the entirety of which is incorporated herein by reference.

FIELD OF THE INVENTION

The present invention relates in general to protective devices and more specifically to blast and ballistic resistant structural insulated panels. The blast and ballistic resistant structural insulated panels can additionally include signal defense capabilities.

BACKGROUND OF THE INVENTION

U.S. Pat. No. 4,566,237, issued to Turner, teaches an armored panel construction for a shelter to defeat ballistic fragment and thermal radiation threats comprises an inner structural panel of aluminum alloy sheets bonded to a honeycomb core and an outer face panel of an aramid fiber fabric in a multi-ply resin matrix laminate. The face panel is said to be in a specific spaced relationship to the inner structural panel such that the energy of an impacting projectile is distributed over a large area and the face panel is allowed to flex inwardly in the absorption of such energy.

McQuilkin, in U.S. Pat. No. 5,435,226, provides a structural armor assembly including a superplastically formed sandwich member having on one side one face sheet of high toughness, high-strength titanium alloy material, and on the other side a second face sheet made of non-superplastically formable metal matrix composite abrasive material. Abrasive materials in the form of KEVLAR or SPECTRA are provided inside cells in the sandwich member to serve as a "catcher's mitt" to absorb part or all of the energy of the ballistic fragments after they have been abraded by the material of the second face sheet.

U.S. Pat. No. 5,640,824, issued to Johnson et al., describes bridge girt assemblies, and modular building panels, for use in fabricating walls, floors and roofs of buildings. The panels have structures adapted to protect the interior of the building from intrusion of heat and cold, and/or from fire, and/or from small arms gunfire. Some embodiments of the invention of Johnson et al. also provide mechanical reinforcing connections between the building structural members and the outside of the building. The modular panels can be made entirely with noncombustible materials.

Jordan, in U.S. Pat. No. 5,791,118, discloses a damage resistant sandwich panel having a first outer face sheet for forming an outer face, a second inner face sheet for forming an inner face, and a core sandwiched between the first outer face sheet and the second inner face sheet. The core is a corrugated sheet having a plurality of elongated crests, a plurality of elongated valleys, and bridging core material between the elongated crests and the elongated valleys. This bridging core material is disposed at acute angles relative to each of the elongated crests and the elongated valleys. The first outer face sheet, the second inner face sheet and the core are constructed from a material having a tensile yield strength (elastic limit) in excess of 20,000 psi and a tensile strain to yield ratio exceeding 2.0%; a preferred material is fiber glass. The elongated crests of the core are fastened to the outer face sheet and the elongated valleys of the core are fastened to the inner face sheet to provide a first and largest spatial separation between the outer face sheet and the inner face sheet. When compressed by forces impacting the outer face sheet and/or the inner face sheet, the elongated crests and the elongated valleys of the core compress against the outer face sheet and inner face sheet to dispose the bridging core material between the elongated crests and the elongated valleys substantially normal to the outer face sheet and the inner face sheet.

U.S. Pat. No. 6,080,495, issued to Wright teaches a structural panel having one or more face sheets bonded by adhesive layers to a core body having two outer plastic liner sheets fusion-bonded to linear ends of inner plastic truss elements spaced apart with open spaces therebetween extending in a plane direction of the plastic liner sheets. The sheet-to-sheet adhesive bonding is said to provide a high-strength laminate bonding that is very resistant to delamination, simple and inexpensive, and can be carried out by a preferred continuous sheet bonding technique. The all-plastic core body is said to be highly resistant to moisture attack, and the open spaces between truss elements provide flexibility to accommodate thermal expansion and contraction. Wright states that his truss construction of the core body provides high compressive and shear strength, while minimizing the amount of material required to be used. In one preferred embodiment, two metal face sheets are used, and the core body has plastic liner sheets fusion-bonded to a corrugated plastic core sheet. The corrugated plastic core sheet can be formed by a continuous plastic extrusion technique. Diagonal plastic webs or perpendicular plastic I-beams may also be used for the truss elements.

Bryant, in U.S. Pat. No. 6,314,704, provides a structural building panel including a composite truss member having transverse truss elements defining an undulated shape, and first and second composite skins, formed by a pultrusion process. A composite connector extends along a side edge of the panel, the connector including a tongue and a groove adjacent one another defining an inside face having an elongate aperture therein that extends parallel to the side edge. The connector may slidably engage with a similar connector on an adjacent panel, the tongues and groove interlocking such that the apertures together define a channel through which a rod-like locking member may be received. Composite connection systems are provided in the invention of Bryant for connecting composite wall panels to a foundation and to connect composite roof panels to the wall panels. The connection systems include interlocking connectors having apertures for receiving locking members. A base connector may be bolted to a foundation, wall panels may be placed on the base connector, and a base retaining clip attached to the base connector to secure the wall panels to the base connector. A cap member may be attached to an upper edge of the wall panels, a plurality of roof panels placed on the cap member, and a cap retaining clip attached to secure the roof panels to the wall panels. Corner members including connectors are provided for connecting wall panels at corners of the building structure being erected.

U.S. Pat. No. 6,656,858, issued to Cahill, describes a laminate wall structure which can be used as an exterior wall in manufactured housing and site built construction which is made up of a low density layer having a density of from about one-half pound to three pounds per cubic foot, a second, reinforcing layer laminated to the low density layer and, optionally, a cellulosic layer laminated to the second, reinforcing layer. The low density layer is said to be preferably a foamed polymer layer, the second, reinforcing layer is a polymer fabric, a biaxially oriented polymeric film or a fiberglass reinforced material and the cellulosic layer can be impregnated with an adhesive and/or resin in order to strengthen the laminate structure. This laminate wall structure is said to have a low weight yet be strong enough to meet wind zone wall diaphragm requirements for housing construction.

Santa Cruz et al., in U.S. Pat. No. 6,679,008, disclose a building that may be assembled from only interconnecting corrugated sheets without the need for expensive brackets or specialized assembly tools and which is said to be quick and easy to construct using the inventive construction method as taught therein. The building further provides a roof construction that is extremely strong and is said to eliminate the need for typical roof trusses. Also the building can be custom designed and used for any purpose of consumer choice, and may be sold as a kit with complete assembly instructions.

U.S. Pat. No. 7,127,865, issued to Douglas, teaches a polymeric panel system and method for production and use thereof, enabling the rapid construction of a building foundation wall or other structure and in particular a below-grade foundation. The polymeric foundation system includes polymeric wall panels and other components suitable for withstanding lateral and end compression loads. The walls include two parallel faces separated by a series of webs or ribs, where the webs and faces of the wall panels may be formed of a similar polymer material such as polyvinylchloride (PVC). The wall panels and/or other components may be extruded so as to enable the rapid production of sections of wall panels, where the panels may be cut to length and then affixed to adjacent panels to form a foundation wall. The method of affixing adjacent panels may include welding, gluing or other techniques and may be performed on the job site or in a pre-fabrication facility. Furthermore, the wall panels may be co-extruded with an insulating material inserted in the voids between the parallel faces so as to provide improved thermal performance of the foundation as well.

Forrester et al., in U.S. Pat. No. 7,134,250, provide a building or insulating panel including a collapsible frame of generally square or rectangular configuration, which is collapsible between a generally flat condition and an erected condition in which it is installed. The frame including overlying top and bottom sheets that are generally parallel and spaced apart in the erected condition of the frame by two webs which are spaced apart to extend in generally parallel relationship lengthwise along opposite side regions of the frame. The webs extend substantially perpendicular to the top and bottom sheets in the erected condition and are disposed substantially parallel to the top and bottom sheets in the collapsed condition. The panel further includes reinforcing means which is inserted between the top and bottom sheets when the frame is in the erected condition to reinforce the panel against collapse. The insulating panel may have an intermediate sheet disposed between the top and bottom sheets which is adhesively connected to each of the top and bottom sheets. The intermediate sheet is formed as a corrugated sheet and at least one of the top and bottom sheets and the intermediate sheet are formed from reflective insulating foil to create a reflective air space.

U.S. Pat. No. 7,398,624, issued to Swiszcz et al., describes a structural panel for use in building structures or in the formation, finish or decoration thereof which includes an outer sheet and a connector sheet with a plurality of collapsible or compressible dividers therebetween. The panel in a rest condition is expanded and of a desired thickness for final use but can be compressed into a relatively thin thickness or profile for shipping purposes. The panel is very lightweight but structurally strong and can be selectively bent in one transverse direction if desired. The panel can be easily cut or formed into any predetermined size or shape.

Hallissy et al., in U.S. Pat. No. 7,406,806, disclose blast resistant prefabricated wall panels containing at least one panel consisting of two structural boards having a thermoset resin-impregnated fiber reinforcing layer therebetween and extending from sides of the panel, the extension wrapped at least partially around metal sole and top plates of a metal sole plate, top plate, and stud construction. The panels are said to be capable of resisting explosive blasts without forming secondary projectiles, and are preferably attached to a building structure by energy absorbing deformable brackets.

U.S. Pat. No. 7,562,508, issued to Dickinson et al., teaches a shelter comprising a roof, a floor, and a plurality of side walls secured to the floor and the roof. At least one of the floor, the roof; and the plurality of side walls comprises an exterior panel, an interior panel, and an attachment device secured to the exterior panel and the interior panel for relative movement of the exterior panel and the interior panel between collapsed and expanded positions. An associated method of assembling the shelter is also disclosed.

Terry et al., in U.S. Pat. No. 7,913,611, disclose a protection structure comprising an open cell core structure, a top face sheet coupled to the core structure, a bottom face sheet coupled to the core structure distal from the top face sheet, a projectile arresting layer coupled to the top face sheet distal from the core structure and a fragment catching layer couple to the bottom face sheet distal from the core.

U.S. Pat. No. 8,544,240, issued to Hughes, Jr., provides a ballistic resistant construction panel having a series of elongated channels formed by coupling a corrugated member to adjacent planar wall members. These channels are filled with sand to provide the ballistic resistance of the panel. The panels are constructed of a fiber-reinforced plastic material and may be assembled together to form a temporary shelter.

Leahy, in U.S. Pat. No. 8,590,264, describes systems and methods providing a modular building having pre-fabricated panel wall components are easily assembled to form a predetermined structure that provides for mating alignment and securement of the modular panels with each other along their adjoining seams, without requiring additional locking mechanisms for stabilizing the panels.

U.S. Published Patent Application No. 2004/0060245, in the name of Loblick et al., teaches a shelter construction kit including at least six composite panels which are identical prior to the positioning of access openings. Each of the six composite panels has a first side edge having an integrally formed male coupling and a second side edge having an integrally formed female coupling. Each of the first side edge and the second side edge extend outwardly at 45 degrees from the first flat face to the second flat face. When the first side edge of one panel is coupled to the second side edge of another panel in a first orientation the coupled panels are on a common plane. When the first side edge of one panel is inverted and coupled to the second side edge of another panel in a second orientation the coupled panels form a 90 degree corner. Roof/wall interface brackets are also provided by Loblick et al., to secure the roof panels in place along with assembly instructions describing how to couple the panels.

Meeker, in U.S. Published Patent Application No. 2006/0248827, provides a ballistic barrier wall constructed of a pair of spaced vertical surfaces connected by 2×4s, 2×8s or other boards and filled with sand. The outside is spray-coated on both vertical sides with an elastomeric polymer mixture. Panels or walls are connected to other panels and to floor or wall surfaces by straight brackets and angle brackets. The multiple vertical layers of the panel are said to trap bullets, armor piercing shells, bomb shrapnel or other ballistic elements in the wall.

U.S. Published Patent Application No. 2008/0078038, in the name of Borazghi, describes a fiber reinforced thermoplastic composite panel. One use of the panel is to construct bridge decks although the panel may have several other uses. It comprises two flat plates formed of commingled glass fiber reinforced polypropylene secured in spaced parallel relationship to a core. The core is formed by either two corrugated sheets interconnected together along connecting ridge sections or else by a plurality of elongated glass fiber reinforced polypropylene (FRP) channel members disposed transversely between the flat plates. The corrugated sheets or channel members form hollow core spaces between the two flat plates and the core material and these hollow spaces are filled with a filler material to add stability to the panel. Both the flat plates and the core material are formed of commingled glass fiber reinforced polypropylene.

Improved structural insulated panels are always desired in the art. Such panels should be light weight, able to be quickly and easily assembled into structures with available fasteners, and should afford the inhabitants with a measure of protection from blast and ballistics events. Optionally, these panels should be able to incorporate the signal defense films such where the assembled shelters are used for constructing sensitive compartmented information facilities ("SCIFs").

SUMMARY OF THE INVENTION

In one embodiment, the present invention provides structural insulated panels which may afford protection from blast and ballistics events. In another embodiment, the structural insulated panels may additionally provide for signal defense. The inventive structural insulated panel comprises a metal sheet, a polyurethane or polyisocyanurate foam and a polycarbonate sheet, film or laminate. Due to the materials of their construction, the inventive panels are lightweight and a plurality of such panels may be quickly and easily assembled into sturdy, insulated, temporary or permanent shelters for protection in a variety of situations and environments.

These and other advantages and benefits of the present invention will be apparent from the Detailed Description of the Invention herein below.

BRIEF DESCRIPTION OF THE FIGURES

The present invention will now be described for purposes of illustration and not limitation in conjunction with the figures, wherein.

DETAILED DESCRIPTION OF THE INVENTION

Figure 1:
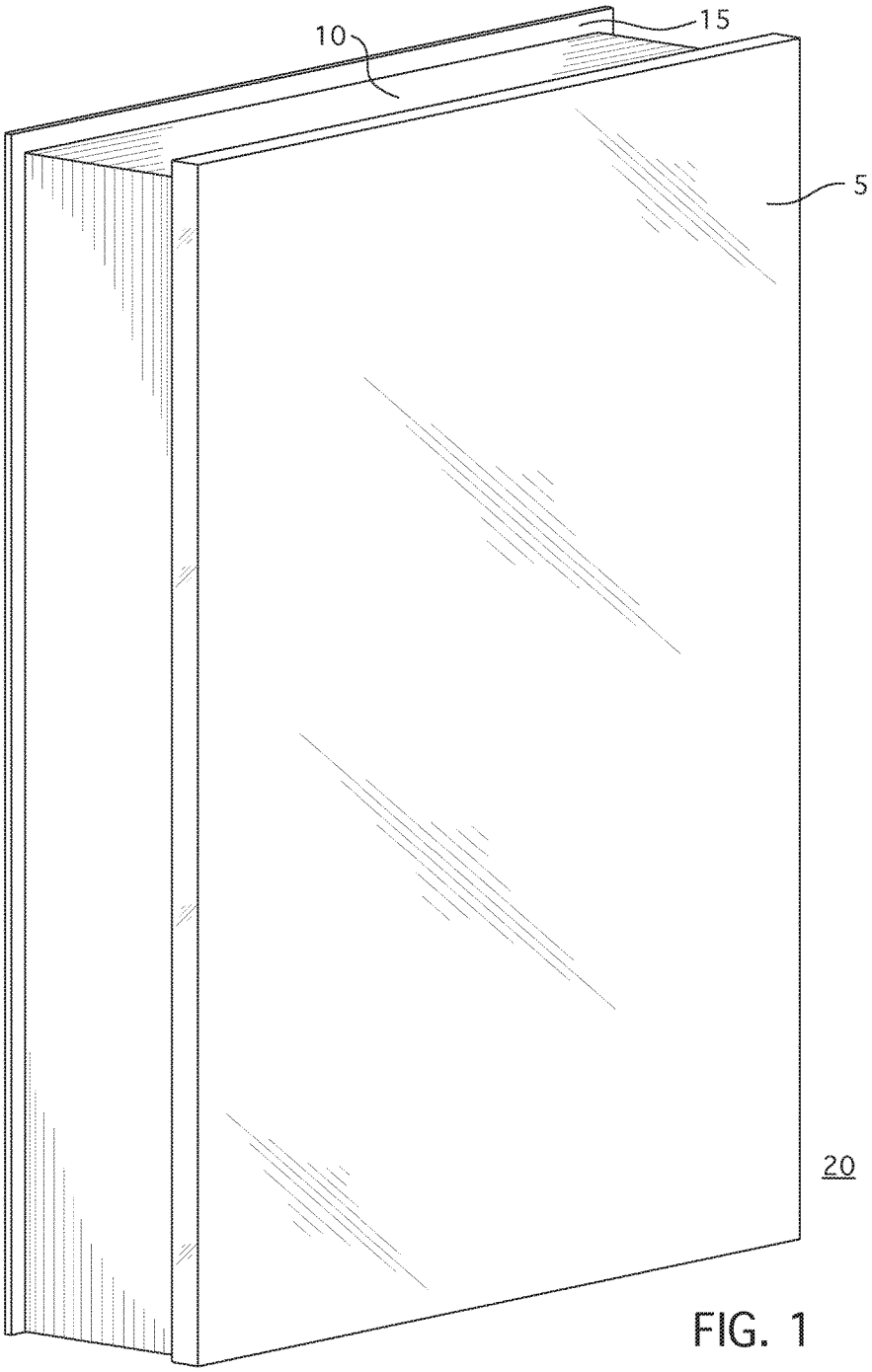
FIG. 1 shows the polycarbonate face of the structural insulated panel of the present invention.

The present invention will now be described for purposes of illustration and not limitation. Except in the operating examples, or where otherwise indicated, all numbers expressing quantities, percentages, OH numbers, functionalities and so forth in the specification are to be understood as being modified in all instances by the term "about." Equivalent weights and molecular weights given herein in Daltons (Da) are number average equivalent weights and number average molecular weights respectively, unless indicated otherwise.

In some embodiments, the polycarbonate sheets, films and laminates useful in the inventive structural insulated panel are transparent, but the present inventors contemplate situations where they may be translucent, or opaque, or even decorative when using laminates. Suitable polycarbonate resins for preparing the sheets useful in the structural insulated panel of the present invention are homopolycarbonates and copolycarbonates, both linear or branched resins and mixtures thereof.

In some embodiments of the invention, the polycarbonates have a weight average molecular weight of from 10,000 to 200,000 (measured by gel permeation chromatography). In other embodiments, the polycarbonates have a weight average molecular weight of from 20,000 to 80,000. In some embodiments, the polycarbonates of the present invention have a melt flow rate, per ASTM D-1238 at 300° C. of from 1 to 65 g/10 min., alternatively, the melt flow rate may be from 2 to 35 g/10 min. The polycarbonates useful in embodiments of the invention may be prepared, for example, by the known diphasic interface process from a carbonic acid derivative such as phosgene and dihydroxy compounds by polycondensation (See, German Offenlegungsschriften 2,063,050; 2,063,052; 1,570,703; 2,211,956; 2,211,957 and 2,248,817; French Patent 1,561,518; and the monograph by H. Schnell, "Chemistry and Physics of Polycarbonates", Interscience Publishers, New York, N.Y., 1964).

In the present context, dihydroxy compounds suitable for the preparation of the polycarbonates useful in embodiments of the invention conform to the structural formulae (1) or (2) below.

(1)

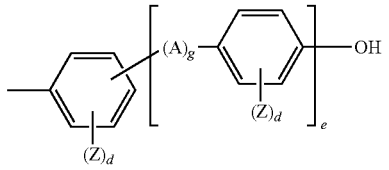

-continued (2)

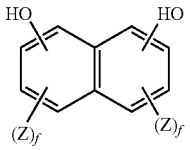

wherein

A denotes an alkylene group with 1 to 8 carbon atoms, an alkylidene group with 2 to 8 carbon atoms, a cycloalkylene group with 5 to 15 carbon atoms, a cycloalkylidene group with 5 to 15 carbon atoms, a carbonyl group, an oxygen atom, a sulfur atom, —SO— or —$SO_2$ or a radical conforming to (3)

(3)

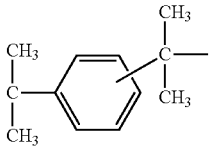

e and g both denote the number 0 to 1;

Z denotes F, Cl, Br or $C_1$-$C_4$-alkyl and if several Z radicals are substituents in one aryl radical, they may be identical or different from one another;

d denotes an integer of from 0 to 4; and f denotes an integer of from 0 to 3.

Among the dihydroxy compounds useful in producing polycarbonates for embodiments of the invention are hydroquinone, resorcinol, bis-(hydroxyphenyl)-alkanes, bis-(11ydroxyl-phenyl)-ethers, bis-(hydroxyphenyl)-ketones, bis-(11ydroxyl-phenyl)-sulfoxides, bis-(hydroxyphenyl)-sulfides, bis-(hydroxyphenyl)-sulfones, and α,α-bis-(hydroxyphenyl)-diisopropylbenzenes, as well as their nuclear-alkylated compounds. These and further suitable aromatic dihydroxy compounds are described, for example, in U.S. Pat. Nos. 5,401,826, 5,105,004; 5,126,428; 5,109,076; 5,104,723; 5,086,157; 3,028,356; 2,999,835; 3,148,172; 2,991,273; 3,271,367; and 2,999,846, the contents of which are incorporated herein by reference.

Further examples of suitable bisphenols are 2,2-bis-(4-hydroxyphenyl)-propane (bisphenol A), 2,4-bis-(4-hydroxyphenyl)-2-methyl-butane, 1,1-bis-(4-hydroxyphenyl)-cyclohexane, α,α'-bis-(4-hydroxy-phenyl)-p-diisopropylbenzene, 2,2-bis-(3-methyl-4-hydroxyphenyl)-propane, 2,2-bis-(3-chloro-4-hydroxyphenyl)-propane, 4,4'-dihydroxy-diphenyl, bis-(3,5-dimethyl-4-hydroxyphenyl)-methane, 2,2-bis-(3,5-dimethyl-4-hydroxyphenyl)-propane, bis-(3,5-dimethyl-4-hydroxyphenyl)-sulfide, bis-(3,5-dimethyl-4-hydroxy-phenyl)-sulfoxide, bis-(3,5-dimethyl-4-hydroxyphenyl)-sulfone, dihydroxy-benzophenone, 2,4-bis-(3,5-dimethyl-4-hydroxyphenyl)-cyclohexane, α,α'-bis-(3,5-dimethyl-4-hydroxyphenyl)-p-diisopropyl-benzene and 4,4'-sulfonyl diphenol.

Examples of aromatic bisphenols useful in various embodiments are 2,2-bis-(4-hydroxyphenyl)-propane (bisphenol A), 2,2-bis-(3,5-dimethyl-4-hydroxyphenyl)-propane, 1,1-bis-(4-hydroxyphenyl)-cyclohexane and 1,1-bis-(4-hydroxy-phenyl)-3,3,5-trimethylcyclohexane.

The polycarbonates suitable in producing the structural insulated panel of embodiments of the invention may entail in their structure units derived from one or more of the suitable bisphenols.

Among the resins suitable in the practice of the invention are phenolphthalein-based polycarbonate, copolycarbonates and terpoly-carbonates such as are described in U.S. Pat. Nos. 3,036,036 and 4,210,741, both of which are incorporated by reference herein.

The polycarbonates of some embodiments of the invention may also be branched by condensing therein small quantities, e.g., 0.05 to 2.0 mol % (relative to the bisphenols) of polyhydroxyl compounds. Polycarbonates of this type have been described, for example, in German Offenlegungsschriften 1,570,533; 2,116,974 and 2,113,374; British Patents 885,442 and 1,079,821 and U.S. Pat. No. 3,544,514, which is incorporated herein by reference. The following are some examples of polyhydroxyl compounds which may be used for this purpose: phloroglucinol; 4,6-dimethyl-2,4,6-tri-(4-hydroxy-phenyl)-heptane; 1,3,5-tri-(4-hydroxyphenyl)-benzene; 1,1,1-tri-(4-hydroxyphenyl)-ethane; tri-(4-hydroxyphenyl)-phenyl-methane; 2,2-bis-[4,4-(4,4'-dihydroxydiphenyl)]-cyclohexyl-propane; 2,4-bis-(4-hydroxy-1-isopropylidine)-phenol; 2,6-bis-(2'-dihydroxy-5'-methylbenzyl)-4-methyl-phenol; 2,4-dihydroxybenzoic acid; 2-(4-hydroxy-phenyl)-2-(2,4-dihydroxy-phenyl)-propane and 1,4-bis-(4,4'-dihydroxytri-phenylmethyl)-benzene. Some of the other polyfunctional compounds are 2,4-dihydroxy-benzoic acid, trimesic acid, cyanuric chloride and 3,3-bis-(4-hydroxyphenyl)-2-oxo-2,3-dihydroindole.

In addition to the polycondensation process mentioned above, alternate processes for the preparation of the polycarbonates of the invention are polycondensation in a homogeneous phase and transesterification. The suitable processes are disclosed in U.S. Pat. Nos. 3,028,365; 2,999,846; 3,153,008; and 2,991,273 which are incorporated herein by reference.

In some embodiments, the process for the preparation of polycarbonates is the interfacial polycondensation process. Other methods of synthesis in forming the polycarbonates of the invention, such as disclosed in U.S. Pat. No. 3,912,688, incorporated herein by reference, may alternatively be used. Suitable polycarbonate resins are available in commerce, for instance, from Bayer MaterialScience under the MAKROLON trademark. In various embodiments, the polycarbonate is used in the form of sheets or films in the inventive structural insulated panel. Suitable polycarbonate sheets are commercially available under the HYGARD trademark.

In the manufacture of rigid foams used in embodiments of the present invention, two preformulated components may be used, commonly called the A-component (also called the A-side) and the B-component (or B-side). Typically, the A-component contains the isocyanate compound which is reacted with the polyol containing B-component to form the foam, with the remainder of the foam-forming ingredients distributed in one or both of these two components or in yet another component or components.

In several embodiments of the present invention, organic polyisocyanate may be employed in the preparation of the rigid foams including aromatic, aliphatic and cycloaliphatic polyisocyanates and combinations thereof. Suitable polyisocyanates are described, for example, in U.S. Pat. Nos. 4,795,763, 4,065,410, 3,401,180, 3,454,606, 3,152,162, 3,492,330, 3,001,973, 3,394,164 and 3,124,605, the entire contents of which are incorporated herein by reference thereto.

Examples of such polyisocyanates are the diisocyanates such as m-phenylene diisocyanate, toluene-2,4-diisocyanate, toluene-2,6-diisocyanate, mixtures of 2,4- and 2,6-toluene diisocyanate, hexamethylene-1,6-diisocyanate, tetramethylene-1,4-diisocyanate, cyclohexane-1,4-diisocyanate, hexahydrotoluene 2,4- and 2,6-diisocyanate, naphthalene-1,5-diisocyanate, 4,4'-diphenylmethane diisocyanate (MDI), polymeric MDI (PMDI), 4,4'-diphenylenediisocyanate, 3,3'-dimethoxy-4,4'-biphenyl-diisocyanate, 3,3'-dimethyldiphenylmethane-4,4'-diisocyanate; the triisocyanates such as 4,4',4'-triphenylmethane-triisocyanate, polymethylenepolyphenyl isocyanate, toluene-2,4,6-triisocyanate; and the tetraisocyanates such as 4,4'-dimethyldiphenylmethane-2,2',5,5'-tetraisocyanate.

In alternate embodiments, prepolymers may also be employed in the preparation of the foams of the present invention. Prepolymers may be prepared by reacting an excess of organic polyisocyanate or mixtures thereof with a minor amount of an active hydrogen-containing compound as determined by the well-known Zerewitinoff test, as described by Kohler in "Journal of the American Chemical Society," 49, 3181 (1927). These compounds and their methods of preparation are well known in the art. The use of any one specific active hydrogen compound is not critical, any such compound can be employed in the practice of the present invention.

In some embodiments, the preferred isocyanate for inclusion in the foams is polymeric MDI (PMDI), or prepolymers of PMDI.

The polyol component of the foams of the structural insulated panels of the present invention is a polyol blend of at least one polyester polyol and at least one polyether polyol. The polyether polyol and the polyester polyol are present at in the blend at ratio of 70:30 to 40:60.

Polyether polyols useful in embodiments of the present invention include the reaction products of a polyfunctional active hydrogen initiator and a monomeric unit such as ethylene oxide, propylene oxide, butylene oxide and mixtures thereof, with propylene oxide, ethylene oxide or mixed propylene oxide and ethylene oxide preferred in various embodiments. In some embodiments, the polyfunctional active hydrogen initiator has a functionality of 2-8, and alternatively the initiator has a functionality of 3 or greater (e.g., 4-8).

A wide variety of initiators may be alkoxylated to form useful polyether polyols. Thus, for example, poly-functional amines and alcohols of the following type may be alkoxylated: monoethanolamine, diethanolamine, triethanolamine, ethylene glycol, polyethylene glycol, propylene glycol, hexanetriol, polypropylene glycol, glycerine, sorbitol, trimethylolpropane, pentaerythritol, sucrose and other carbohydrates. In some embodiments, polyether polyols based on sucrose or sorbitol are included. Such amines or alcohols may be reacted with the alkylene oxide(s) using techniques known to those skilled in the art. The hydroxyl number which is desired for the finished polyol determines the amount of alkylene oxide used to react with the initiator. The polyether polyol may be prepared by reacting the initiator with a single alkylene oxide, or with two or more alkylene oxides added sequentially to give a block polymer chain, or at once to achieve a random distribution of such alkylene oxides. Polyol blends such as a mixture of high molecular weight polyether polyols with lower molecular weight polyether polyols may also be employed in various embodiments.

The alkylene oxides which may be used in the preparation of the polyol include any compound having a cyclic ether group, preferably an α,β-oxirane, and are unsubstituted or alternatively substituted with inert groups which do not chemically react under the conditions encountered in preparing a polyol. Examples of suitable alkylene oxides include ethylene oxide, propylene oxide, 1,2- or 2,3-butylene oxide, the various isomers of hexane oxide, styrene oxide, epichlorohydrin, epoxychlorohexane, epoxychloropentane and the like. Most preferred, on the basis of performance, availability and cost are ethylene oxide, propylene oxide, butylene oxide and mixtures thereof, with ethylene oxide, propylene oxide, or mixtures thereof being most preferred in some embodiments. If polyols are prepared with combinations of alkylene oxides, the alkylene oxides may be reacted as a complete mixture providing a random distribution of oxyalkylene units within the oxide chain of the polyol or alternatively they may be reacted in a step-wise manner so as to provide a block distribution within the oxyalkylene chain of the polyol.

The polyester polyols useful in embodiments of the invention may be prepared by known procedures from a polycarboxylic acid or acid derivative, such as an anhydride or ester of the polycarboxylic acid, and a polyhydric alcohol. The acids and/or the alcohols may be used as mixtures of two or more compounds in the preparation of the polyester polyols. In some embodiments, polyesters having OH numbers of less than 350 mg KOH/g are used, alternatively, polyesters having OH numbers of less than 300 mg KOH/g may be included in the foams.

In various embodiments of the present invention, the polycarboxylic acid component, is dibasic, and may be aliphatic, cycloaliphatic, aromatic and/or heterocyclic and may optionally be substituted, for example, by halogen atoms, and/or may be unsaturated. Examples of suitable carboxylic acids and derivatives thereof for the preparation of the polyester polyols include: oxalic acid; malonic acid; succinic acid; glutaric acid; adipic acid; pimelic acid; suberic acid; azelaic acid; sebacic acid; phthalic acid; isophthalic acid; trimellitic acid; terephthalic acid; phthalic acid anhydride; tetrahydrophthalic acid anhydride; pyromellitic dianhydride; hexahydrophthalic acid anhydride; tetrachlorophthalic acid anhydride; endomethylene tetrahydrophthalic acid anhydride; glutaric acid anhydride; maleic acid; maleic acid anhydride; fumaric acid; dibasic and tribasic unsaturated fatty acids optionally mixed with monobasic unsaturated fatty acids, such as oleic acid; terephthalic acid dimethyl ester and terephthalic acid-bis-glycol ester.

Any suitable polyhydric alcohol may be used in preparing the polyester polyols. In various embodiments, the polyols can be aliphatic, cycloaliphatic, aromatic and/or heterocyclic, and selected from the group consisting of diols, triols and tetrols. Aliphatic dihydric alcohols having no more than 20 carbon atoms are highly satisfactory. Alternatively, the polyols may include substituents which are inert in the reaction, for example, chlorine and bromine substituents, and/or may be unsaturated. Suitable amino alcohols, such as, for example, monoethanolamine, diethanolamine, triethanolamine, or the like may also be used. Moreover, the polycarboxylic acid(s) may be condensed with a mixture of polyhydric alcohols and amino alcohols.

Examples of suitable polyhydric alcohols include, but are not limited to, ethylene glycol; propylene glycol-(1,2) and -(1,3); butylene glycol-(1,4) and -(2,3); hexane diol-(1,6); octane diol-(1,8); neopentyl glycol; 1,4-bis-hydroxymethyl cyclohexane; 2-methyl-1,3-propane diol; glycerin; trimethylolpropane; trimethylolethane; hexane triol-(1,2,6); butane triol-(1,2,4); pentaerythritol; quinitol; mannitol; sorbitol; formitol; α-methyl-glucoside; diethylene glycol; triethylene glycol; tetraethylene glycol and higher polyethyleneglycols; dipropylene glycol and higher polypropylene glycols as well as dibutylene glycol and higher polybutylene glycols. Particularly preferred are oxyalkylene glycols, such as diethylene glycol, dipropylene glycol, triethylene glycol, tripropylene glycol, tetraethylene glycol, tetrapropylene glycol, trimethylene glycol and tetramethylene glycol.

Other components useful in producing the polyurethane foams useful in the present invention include those known in the art such as surfactants, catalysts, pigments, colorants, fillers, antioxidants, flame retardants, stabilizers, and the like.

The reactivity of the foam of the inventive structural insulated panel may be adjusted with catalyst level Amine-based catalysts are used to initiate the polyurethane reaction and reduce gel time. However, a very high level of amine-based catalysts may lead to accelerated polyurethane foam decomposition reactions at elevated temperatures and therefore reduce the long-term thermal stability. The preferred catalyst in the foam of the present invention is an amine catalyst.

Examples of suitable tertiary amine catalysts include 1,3,5-tris(3-(dimethylamino)propyl)hexahydro-s-triazine, triethylenediamine, N-methylmorpholine, pentamethyl diethylenetriamine, dimethylcyclohexylamine, tetramethylethylenediamine, 1-methyl-4-dimethylaminoethyl-piperazine, 3-methoxy-N-dimethyl-propylamine, N-ethylmorpholine, diethylethanol-amine, N-cocomorpholine, N,N-dimethyl-N',N' diethylisopropyl-propylene diamine, N,N-diethyl-3-diethyl aminopropyl amine and dimethyl-benzyl amine. Examples of suitable organometallic catalysts include organomercury, organolead, organoferric and organotin catalysts, with organotin catalysts being preferred. Suitable organotin catalysts include tin salts of carboxylic acids such as dibutyltin di-2-ethyl hexanoate and dibutyltin dilaurate. Metal salts such as stannous chloride can also function as catalysts for the urethane reaction. A catalyst for the trimerization of polyisocyanates, such as an alkali metal alkoxide or carboxylate may also optionally be employed herein. Also useful are potassium salts of carboxylic acids such as potassium octoate and potassium acetate. Such catalysts are used in an amount which measurably increases the rate of reaction of the polyisocyanate. Typical amounts are 0.01 to 5.0 part of catalyst per 100 parts by weight of polyol.

When preparing polyisocyanate-based foams, it may be advantageous to employ a minor amount of a surfactant to stabilize the foaming reaction mixture until it obtains rigidity. Any suitable surfactant can be employed in the invention, including silicone/ethylene oxide/propylene oxide copolymers. Examples of surfactants useful in the present invention include, among others, polydimethylsiloxane-polyoxyalkylene block copolymers NIAX L-5420, NIAX L-5340, and NIAX Y10744 (available from GE Silicones.); DABCO DC-193 (from Air Products and Chemicals, Inc); and TEGOSTAB B84PI and TEGOSTAB B-8433 (from Goldschmidt Chemical Corp). Other suitable surfactants are described in U.S. Pat. Nos. 4,365,024 and 4,529,745. In other embodiments surfactants including polyethylene glycol ethers of long chain alcohols, tertiary amine or alkanolamine salts of long chain alkyl acid sulfate esters, alkylsulfonic esters, alkylarylsulfonic acids are used. Such surfactants are employed in amounts sufficient to stabilize the foaming reaction mixture against collapse and the formation of large, and uneven cells. In some embodiments, the surfactant comprises from 0.05 to 10, alternatively from 0.1 to 6, weight percent of the foam-forming composition.

The blowing agent included in the foams of the structural insulated panels of the present invention contains one or more of the following: 1,1,1,3,3-pentafluoropropane (HFC-245fa), 1,1,1,2-tetrafluoroethane (HFC-134a), trans-1-chloro-3,3,3-trifluoropropylene (HCFO-1233zd(E)) and 1,1,1,4,4,4-hexafluoro-2-butene (FEA-1100), n-pentane, cyclopentane or isopentane and optionally a minor amount of water. In some embodiments, the blowing agent is present in an amount of 2 to 30 parts by weight (pbw), based on the weight of the foam forming formulation; in other embodiments it is present in amounts of 5-25 pbw.

When carrying out the reaction of the polyol component with the polyisocyanate, the quantity of the polyisocyanate in some embodiments is such that the isocyanate index is from 90 to 400, alternatively, from 95 to 150. The isocyanate index of the foams of the present invention may range between any combination of these values, inclusive of the recited values. By "isocyanate index" is meant the quotient of the number of isocyanate groups divided by the number of isocyanate-reactive groups, multiplied by 100. The foam-forming formulation in the present invention is preferably a liquid at room temperature.

EXAMPLES

The present invention is further illustrated, but is not to be limited, by the following examples. All quantities given in "parts" and "percents" are understood to be by weight, unless otherwise indicated.

Figure 2:
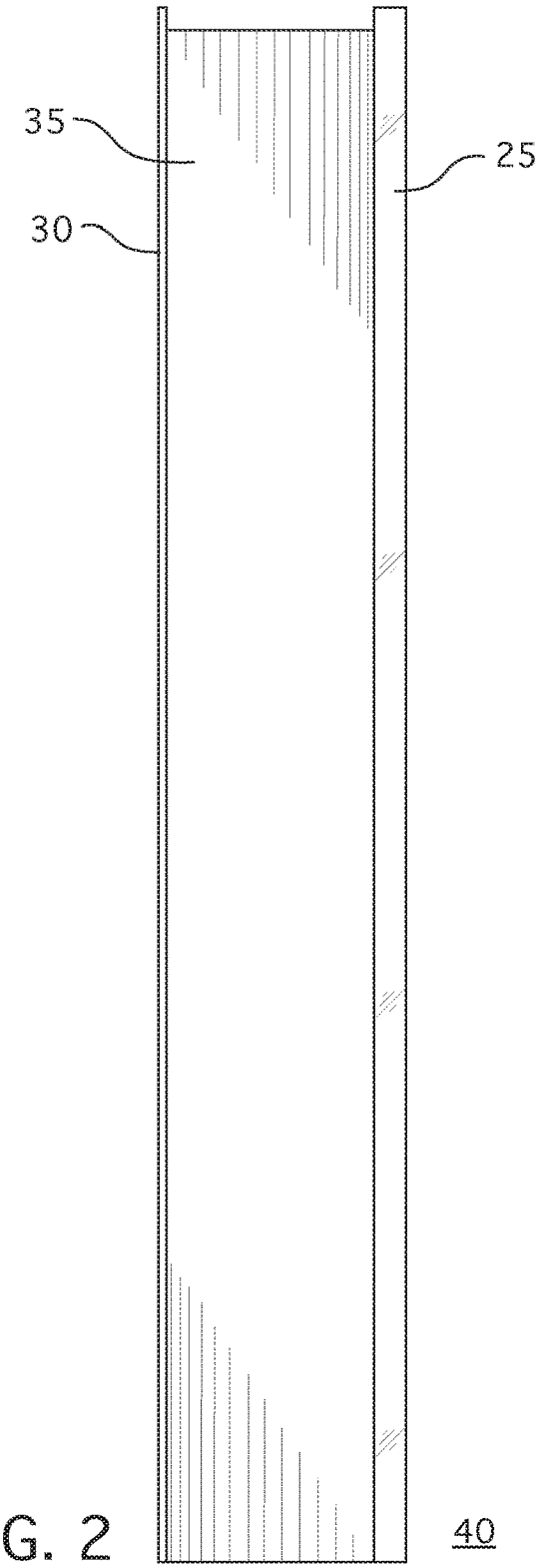
FIG. 2 illustrates a side view of the structural insulated panel of the present invention.

Structural insulated panels of the present invention were prepared for testing. These panels (Samples 1 & 2) were constructed with ½-inch polycarbonate (MAKROLON, commercially available from Bayer MaterialScience) on one of the panel faces and either a thin (20-mil) steel sheet (Sample 1) or an 18-mil steel sheet on the transverse face (Sample 2) with polyurethane foam injected between the faces. FIG. 1 shows the polycarbonate face 5 of the structural insulated panel 20 of the present invention including polyurethane or polyisocyanurate foam 10 and metal layer 15. FIG. 2 illustrates a side view of the structural insulated panel 40 of the present invention with polycarbonate face 25, polyurethane or polyisocyanurate foam 30 and metal layer 35.

Figure 7:
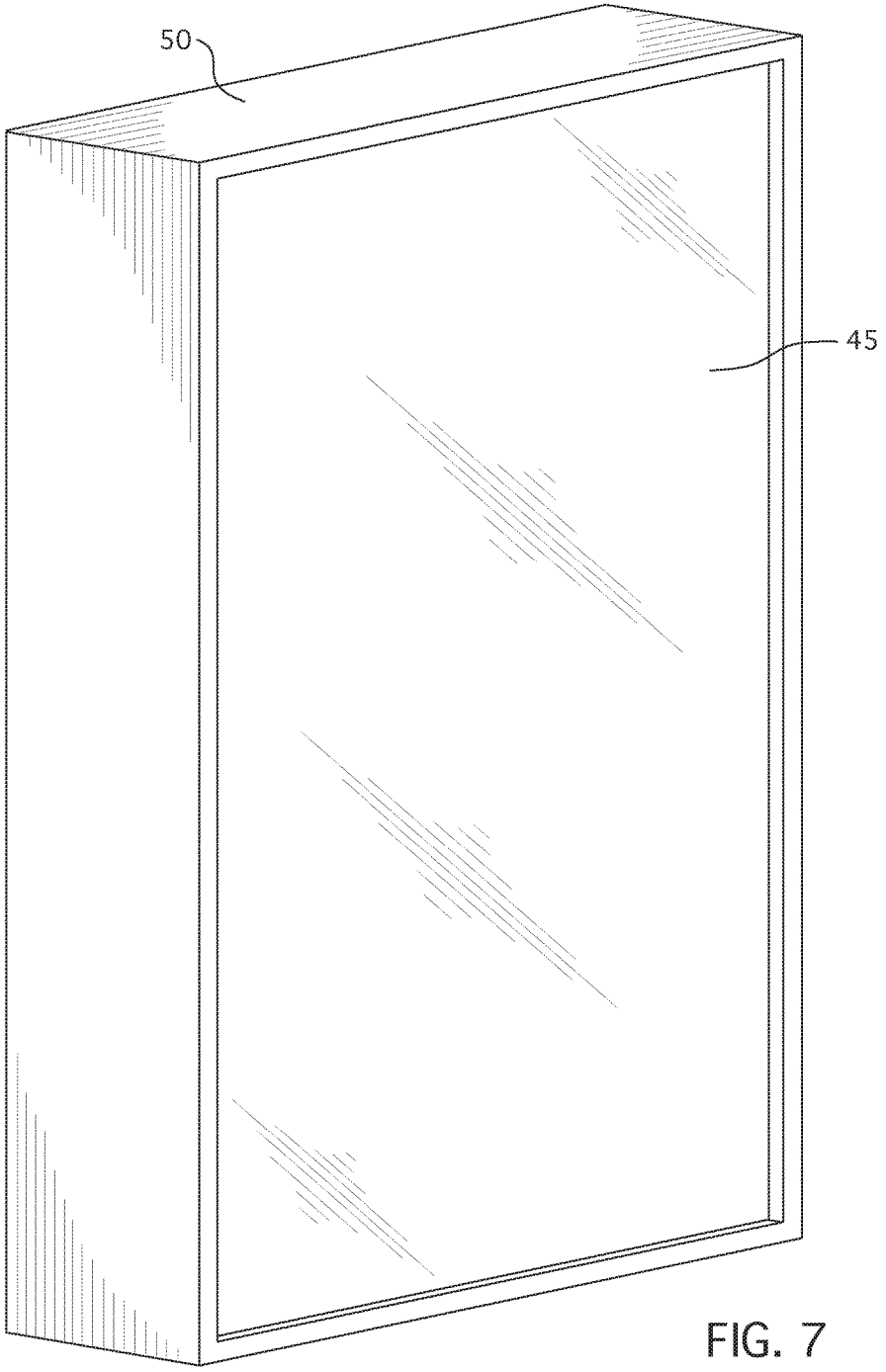
FIG. 7 shows the structural insulated panel with a frame attached to the top, bottom and sides of the panel.

FIG. 7 shows another embodiment of the structural insulated panel of the present invention, with the frame 50 attached to the top, bottom and sides of the panel. Also visible is polycarbonate face 45.

The polyurethane foam was made by combining 36.78 parts of Polyol A (an aromatic amine-initiated polyether polyol having a hydroxyl number of 395 mg KOH/g and a functionality of 4 available from Bayer MaterialScience), 18.35 parts of Polyol B (a sucrose-based polyether polyol having an a hydroxyl number of 370-390 mg KOH/g and a functionality of 5.8 available from Bayer MaterialScience), 23.62 parts of Polyol C (an aromatic polyester polyol blend having a hydroxyl number of 240 mg KOH/g and a functionality of 2.0 available from Stepan Co.), 1.67 parts of an organosilicone foam stabilizer which contains approximately 45% ethylene glycol by weight (available as TEGOSTAB B 8404 from Evonik), 0.35 parts of a tertiary amine catalyst (N,N'-dimethylcyclohexylamine, available from Air Products as POLYCAT 8), 0.35 parts of a tertiary amine catalyst (pentamethyldiethylenetriamine available as DESMORAPID PV from Rhein Chemie Corporation), 1.76 parts of water. To this mixture was added 17.12 parts of blowing agent (1,1,1,3,3-pentafluoropropane available from Honeywell as HFC-245fa). The mixture was then reacted with 104.59 parts of isocyanate (a polymeric diphenylmethane diisocyanate having an NCO group content of 31.5%, a functionality of 2.8, and a viscosity of 196 mPa s at 25° C., commercially available from Bayer MaterialScience as MONDUR MR) at an AB ratio of 1.046 with a dwell time of approximately 20 minutes to allow adhesion of the foam to both the steel and polycarbonate sheets.

The experiments were to determine: (A) if a polycarbonate sheet will sufficiently adhere to the polyurethane foam without mechanical fasteners, and (B) assess whether the resultant panels possess ballistics properties.

As to (A), polycarbonate sheet was shown to adhere to the polyurethane foam by orienting either Samples 1 or 2 so that the polycarbonate sheet was on the top surface, grasping only the polycarbonate sheet edges of the panel, and then hand shaking the panel vigorously. The polycarbonate sheet remained attached to the polyurethane foam of both samples. During ballistics testing, it was noted that Sample 2 with a steel sheet face was shot with both 9 mm (slug weighed 8 g) and .44 Magnum bullets (slug weighed 15.6 g) entering the panel from the steel sheet side without the polycarbonate sheet detaching from the foam. Similarly, the polycarbonate sheet of Sample 1, constructed with the thin steel sheet, remained attached to the foam as well after being shot with a .38 Special bullet (Winchester, 125 gr. JHP).

Figure 4:
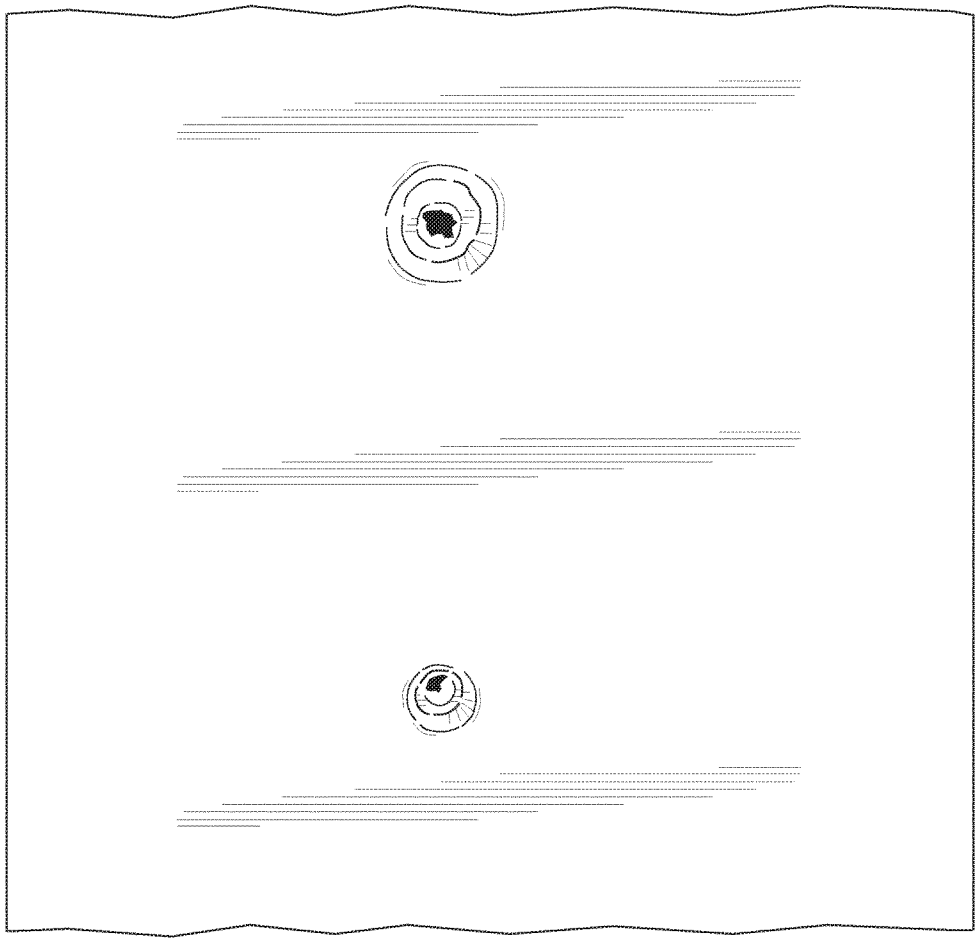
FIG. 4 shows the entry point for a .44 Magnum (left) and a 9 mm (right) bullet in the steel sheet of the inventive structural insulated panel (sample 2)
Figure 6:
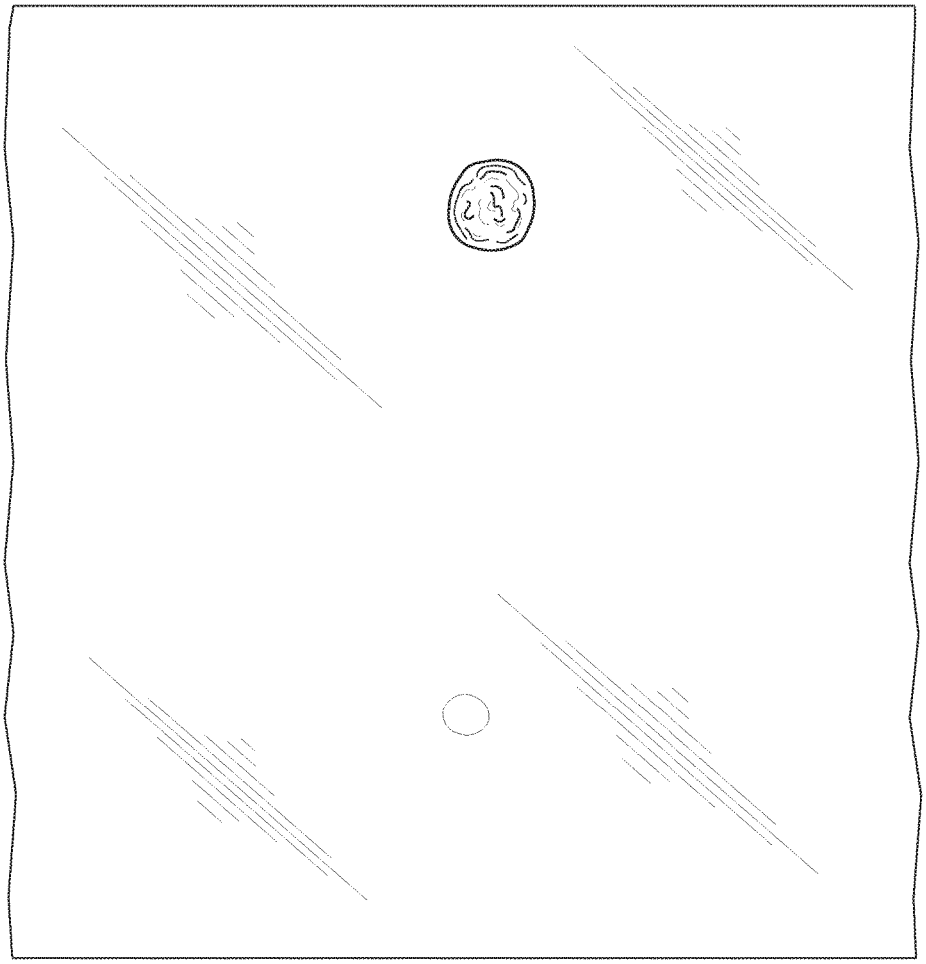
FIG. 6 shows the exit point for a .44 Magnum (top) and a 9 mm (bottom) bullet from the polycarbonate side of the inventive structural insulated panel (sample 2).

FIG. 4 shows the entry point for a .44 Magnum (left) and a 9 mm (right) bullet in the steel sheet of the inventive structural insulated panel. With respect to ballistics testing, the .44 magnum bullet with a velocity of 1,448-ft/sec passed completely through Sample 2. FIG. 6 shows the exit point for a .44 Magnum (top) and a 9 mm (bottom) bullet from the polycarbonate side of the inventive structural insulated panel. Thus, the structural insulated panel of Sample 2 failed this portion of the ballistics test as to the .44 Magnum. In contrast, the smaller 9 mm bullet with a lower velocity of 1,225-ft/sec did not pass through Sample 2.

Figure 3:
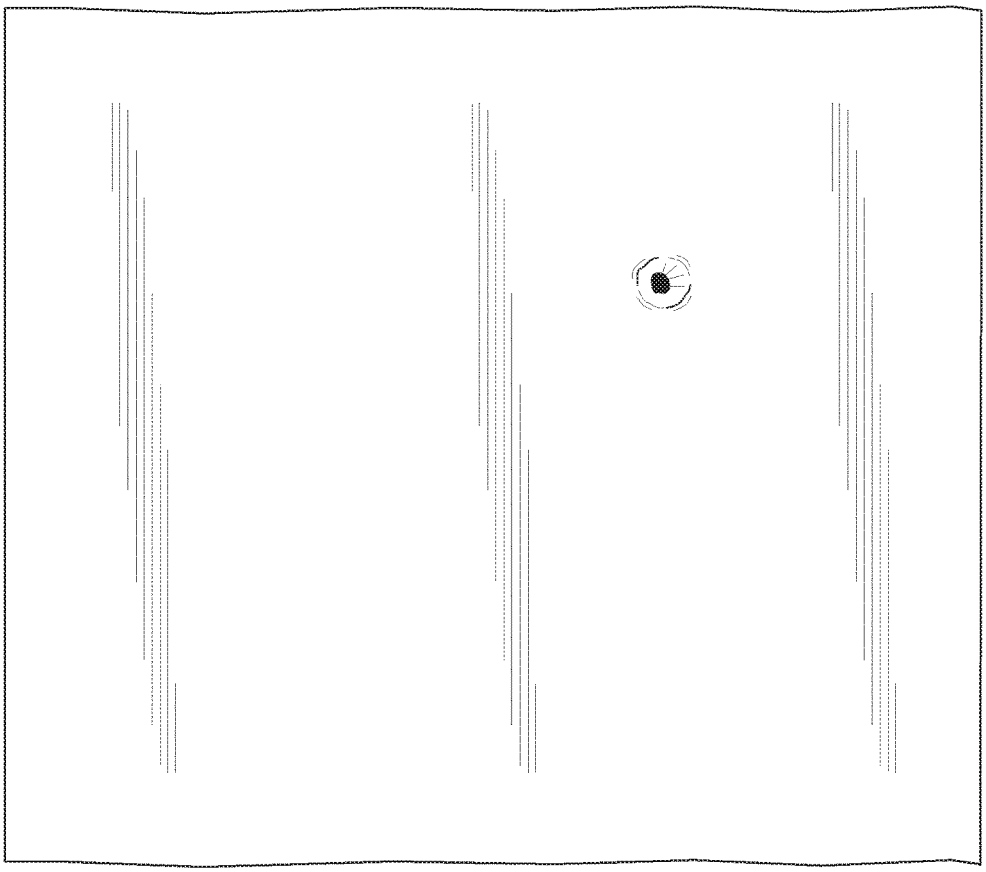
FIG. 3 shows the entry point for a .38 Special bullet in steel sheet of the inventive structural insulated panel (sample 1)
Figure 5:
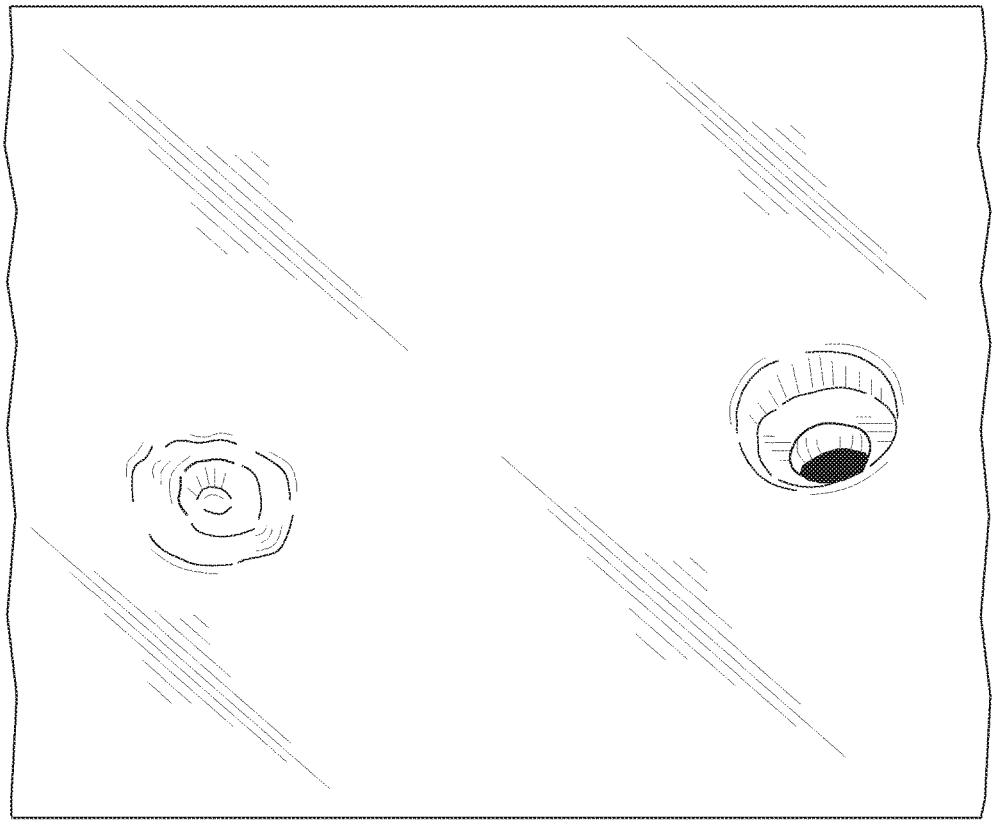
FIG. 5 shows the exit point for a .38 Special bullet from the polycarbonate side of the inventive structural insulated panel (sample 1)

FIG. 3 shows the entry point for a 0.38 Special bullet in steel sheet of the inventive structural insulated panel of Sample 1. As can be appreciated by reference to FIGS. 3 and 5, when the panel of Sample 1 was shot with a .38 Special from 12-ft, the panel stopped the bullet from passing through the panel. FIG. 5 shows the exit point on the right for a .38 Special bullet from the polycarbonate side of the inventive structural insulated panel. As shown in the left side of FIG. 5, the 9 mm bullet did not pass through the panel. In both cases (9 mm and .38 Special), the panel passed the ballistics tests.

Thus, owing to the materials of their construction, the inventive panels are lightweight and may be easily assembled into structures with commonly available mechanical fasteners in a quick manner Such mechanical fasteners include, but are not limited to, screws, nails, rivets, complementary nuts and bolts, tabs, staples, camlocks and similar mechanical latching devices.

Metals useful in producing various embodiments of the structural insulated panels of the present invention include, but are not limited to, steel, aluminum, iron, copper, tin, lead, nickel, brass, titanium, zinc and alloys of any of these.

The present inventors envision the inventive panels may optionally be framed by materials such as wood, metal and composites. Sturdy, insulated, temporary or permanent shelters may be assembled from such panels for protection in a variety of situations and environments.

In some embodiments of the present invention, the panels incorporate signal defense films such as those described in U.S. Pat. Nos. 7,405,872, 7,295,368, 7,177,075 and 6,859,310, the entire contents of which are incorporated by reference, where the assembled shelters are used for constructing sensitive compartmented information facilities ("SCIFs").

The foregoing examples of the present invention are offered for the purpose of illustration and not limitation. It will be apparent to those skilled in the art that the embodiments described herein may be modified or revised in various ways without departing from the spirit and scope of the invention. The scope of the invention is to be measured by the appended claims.

Various aspects of the subject matter described herein are set out in the following numbered clauses:

1. A structural insulated panel comprising a metal sheet, a polyurethane or polyisocyanurate foam; and a polycarbonate sheet, film or laminate.

2. The structural insulated panel according to clause 1, wherein the foam adheres the metal sheet to the polycarbonate sheet, film or laminate.

3. The structural insulated panel according to clause 1, wherein the metal is selected from the group consisting of steel, aluminum, iron, copper, tin, lead, nickel, brass, titanium, zinc and alloys thereof.

4. The structural insulated panel according to clause 1, wherein the metal comprises steel.

5. The structural insulated panel according to clause 1, wherein the panel has ballistics resistance.

6. The structural insulated panel according to clause 1, wherein the panel is framed with one or more materials selected from the group consisting of wood, metal, and composites.

7. The structural insulated panel according to clause 1, wherein the panel is attached to a frame by one or more mechanical fasteners.

8. The structural insulated panel according to clause 1, wherein the foam comprises a polyurethane.

9. The structural insulated panel according to clause 1, wherein the foam comprises a polyisocyanurate.

10. The structural insulated panel according to clause 1 further including one or more signal defense films.

11. A structural insulated panel comprising a metal sheet adhered to a polycarbonate sheet, film or laminate by a polyurethane or a polyisocyanurate foam.

12. The structural insulated panel according to clause 11, wherein the metal is selected from the group consisting of steel, aluminum, iron, copper, tin, lead, nickel, brass, titanium, zinc and alloys thereof.

13. The structural insulated panel according to clause 11, wherein the metal comprises steel.

14. The structural insulated panel according to clause 11, wherein the panel has ballistics resistance.

15. The structural insulated panel according to clause 11, wherein the panel is framed with one or more materials selected from the group consisting of wood, metal, and composites.

16. The structural insulated panel according to clause 11, wherein the panel is attached to a frame by one or more mechanical fasteners.

17. The structural insulated panel according to clause 11, wherein the foam comprises a polyurethane.

18. The structural insulated panel according to clause 11, wherein the foam comprises a polyisocyanurate.

19. The structure according to clause 11 further including one or more signal defense films.

20. A structure comprising a plurality of structural insulated panels, each panel comprising a metal sheet, a polyurethane or a polyisocyanurate foam and a polycarbonate sheet, film or laminate, wherein the foam adheres the metal sheet to the polycarbonate sheet, film or laminate.

21. The structure according to clause 20, wherein the metal is wherein the metal is selected from the group consisting of steel, aluminum, iron, copper, tin, lead, nickel, brass, titanium, zinc and alloys thereof.

22. The structure according to clause 20 wherein the metal comprises steel.

23. The structure according to clause 20, wherein each panel has ballistics resistance.

24. The structure according to clause 20, wherein each panel is framed with one or more materials selected from the group consisting of wood, metal, and composites.

25. The structure according to clause 20, wherein each panel is attached to a frame by one or more mechanical fasteners.

26. The structure according to clause 20, wherein the foam comprises a polyurethane.

27. The structure according to clause 20, wherein the foam comprises a polyisocyanurate.

28. The structure according to clause 20, wherein each panel is framed with one or more materials selected from the group consisting of wood, metal, and composites, and wherein the framed panels are held together by one or more mechanical fasteners.

29. The structure according to clause 20 further including one or more signal defense films.

30. A structure comprising a plurality of structural insulated panels, each panel comprising a metal sheet adhered to a polycarbonate sheet, film or laminate by a polyurethane or a polyisocyanurate foam.

31. The structure according to clause 30, wherein the metal is wherein the metal is selected from the group consisting of steel, aluminum, iron, copper, tin, lead, nickel, brass, titanium, zinc and alloys thereof.

32. The structure according to clause 30, wherein the metal comprises steel.

33. The structure according to clause 30, wherein each panel has ballistics resistance.

34. The structure according to clause 30, wherein each panel is framed with one or more materials selected from the group consisting of wood, metal, and composites.

35. The structure according to clause 30, wherein each panel is attached to a frame by one or more mechanical fasteners.

36. The structure according to clause 30, wherein each panel is framed with one or more materials selected from the group consisting of wood, metal, and composites, and wherein the framed panels are held together by one or more mechanical fasteners.

37. The structure according to clause 30, wherein the foam comprises a polyurethane.

38. The structure according to clause 30, wherein the foam comprises a polyisocyanurate.

39. The structure according to clause 30 further including one or more signal defense films.

What is claimed is:

1. A structural insulated panel comprising:

a metal sheet;

a polyurethane foam having a first side and a second side; and a polycarbonate sheet, film or laminate, wherein the foam adheres the first side to the metal sheet, and adheres the second side to the polycarbonate sheet, film or laminate, and wherein the foam consists of:

one or more isocyanates, one or more polyols consisting of one or more polyester polyols and one or more polyether polyols, a blowing agent, and optionally, one or more compounds selected from the group consisting of:

surfactants, catalysts, pigments, colorants, fillers, antioxidants and flame retardants.

2. The structural insulated panel according to claim 1, wherein the metal is selected from the group consisting of steel, aluminum, iron, copper, tin, lead, nickel, brass, titanium, zinc and alloys thereof.

3. The structural insulated panel according to claim 1, wherein the panel has ballistics resistance.

4. The structural insulated panel according to claim 1, wherein the panel is framed with one or more materials selected from the group consisting of wood, metal, and composites.

5. The structural insulated panel according to claim 1 further including one or more signal defense films.

6. A structure comprising a plurality of structural insulated panels, each panel comprising a metal sheet, a polyurethane foam having a first side and a second side, and a polycarbonate sheet, film or laminate, wherein the foam adheres the first side to the metal sheet, and adheres the second side to the polycarbonate sheet, film or laminate, and wherein the foam consists of: one or more isocyanates, one or more polyols consisting of one or more polyester polyols and one or more polyether polyols, a blowing agent, and optionally, one or more compounds selected from the group consisting of: surfactants, catalysts, pigments, colorants, fillers, antioxidants and flame retardants.

7. The structure according to claim 6, wherein the metal is selected from the group consisting of steel, aluminum, iron, copper, tin, lead, nickel, brass, titanium, zinc and alloys thereof.

8. The structure according to claim 6, wherein the panel has ballistics resistance.

9. The structure according to claim 6, wherein the panel is framed with one or more materials selected from the group consisting of wood, metal, and composites.

10. The structure according to claim 6 further including one or more signal defense films.

11. The structural insulated panel according to claim 1, wherein the foam adheres the first side to the metal sheet, and adheres the second side to the polycarbonate sheet, film or laminate, without mechanical fasteners.

* * * * *